US005810188A

United States Patent [19]

Novakoski et al.

[11] Patent Number: 5,810,188

[45] Date of Patent: Sep. 22, 1998

[54] HINGED CLOSURE FOR CONTAINER

[75] Inventors: Douglas Novakoski, Alameda, Calif.; Gerard Pre, La Tour-De-Peilz, Switzerland

[73] Assignee: Nestec S.A., Vevey, Switzerland

[21] Appl. No.: 679,577

[22] Filed: Jul. 15, 1996

[30] Foreign Application Priority Data

Jul. 11, 1995 [EP] European Pat. Off. ..... 95810697

[51] Int. Cl.[6] ..... B65D 51/18

[52] U.S. Cl. ..... 220/254; 220/324; 220/339; 215/237

[58] Field of Search ..... 215/237, 238; 220/324, 326, 339, 254

[56] References Cited

U.S. PATENT DOCUMENTS

| | | | |
|---|---|---|---|
| 4,424,910 | 1/1984 | Heinol | 215/216 |
| 4,501,378 | 2/1985 | Berfield | 220/324 |
| 4,545,508 | 10/1985 | Cribb, Jr. et al. . | |
| 4,969,573 | 11/1990 | Dupuis et al. . | |
| 5,031,784 | 7/1991 | Wright | 215/216 |
| 5,057,365 | 10/1991 | Finkelstein et al. . | |
| 5,065,885 | 11/1991 | Scaroni . | |
| 5,147,054 | 9/1992 | Pehr | 215/253 |
| 5,405,007 | 4/1995 | Iwahashi | 206/387.1 |
| 5,462,183 | 10/1995 | Rohr et al. | 205/237 |
| 5,582,314 | 12/1996 | Quinn et al. | 220/326 |

FOREIGN PATENT DOCUMENTS

| | | |
|---|---|---|
| 636551A1 | 2/1995 | European Pat. Off. . |
| 0683107A1 | 11/1995 | European Pat. Off. . |
| 2529865 | 1/1984 | France . |
| 2708252 | 2/1995 | France . |
| 1305739 | 2/1973 | United Kingdom . |
| WO 9101925 | 2/1991 | WIPO . |

OTHER PUBLICATIONS

South African Patent Journal, Abstract of Counterpart of Juillet, et al., French Patent Application 93 09218 and Publication No. 2 708 252.

Derwent Abstract, Acc. No. 95–076703/11, of Sautereau, French Patent Application Publication No. 2 708 252 (1995).

Derwent Abstract, Acc. No. 84–029395, of Juillet, et al., French Patent Application Publication No. 2 529 865 (1984).

*Primary Examiner*—Stephen Cronin
*Attorney, Agent, or Firm*—Vogt & O'Donnell, LLP

[57] ABSTRACT

A hinged closure has a ring member, a lid member, a first hinge which connects the ring and lid members, and a locking tab member, hinge and protrusion member assembly. The first hinge connects the lid and ring so that the lid reciprocates for closure and opening and upon closure, edges of a lid skirt and ring skirt mate. The lid has a wall surface which has a recess portion which extends from the lid skirt at a position which opposes the first hinge, and an indent is positioned in the recess portion. The locking tab member is hinged to the ring and extends from the ring and the protrusion member extends from the tab so that upon lid and ring closure, the tab extends to the lid recess and so that the protrusion removably connects to the indent portion to hold the lid and ring member together.

13 Claims, 5 Drawing Sheets

HINGED CLOSURE FOR CONTAINER

The invention relates to a hinged closure for a container, this closure including a ring designed to fit over the edge of the opening of the said container, as well as a lid connected to the ring by a hinge and pressing against this ring in the closed position.

The patent FR 2,529,865 already relates to a hinged closure for a container of oblong cross-section with a ring sealed on the edge of the opening of the container and a lid connected to the said ring by a hinge. This closure comprises a locking system with a protrusion on the said ring which is designed to engage in a hole in the lid: the drawback of this solution is that when the lid is closed, it is very difficult to open it because it is not known a priori how to disengage the protrusion.

The object of the present invention is to find a hinged closure system which gives easy opening for the user, while at the same time guaranteeing good sealing, both primary and secondary. Primary sealing is understood to be sealing before first opening and secondary sealing is understood to be that after first opening.

The invention relates to a hinged closure, according to the preamble of claim 1, in which the ring includes, on the opposite side to the hinge, a locking tab with a tab, hinged onto the said ring and intended to be housed in a corresponding recess in the lid, the said tab clipping into an indent situated in the top of the recess of the lid upon closure.

A container, in the present description, is understood to be a container of substantially rectangular or square cross-section, so that the lid and the ring are substantially rectangular or square. If the container is of rectangular cross-section, the two hinges are along the length of the said rectangles. It would also be possible to have a container of substantially elliptical cross-section, in which case the lid and the ring are also rectangular and the hinges are parallel to the major axis of the ellipse.

The container may be used for packaging any pasty, granular or powdered product, particularly instant coffee. It is clearly understood that it can also be used for packaging cosmetic products. The container is preferably made of glass or an equivalent product, and the hinged closure made of polypropylene, polyolefin or polystyrene, preferably polypropylene. The hinged closure according to the invention may be made as a single piece or as two pieces (lid and ring) and it is moulded or injection-moulded.

The fact that, according to the invention, there is a locking tab with a tab clipping into an indent in the lid makes it possible to have visual security of closure, because the closing of the said tab can be clearly seen, and the security of closure is also audible, because clipping gives out a noise which also guarantees correct closing.

On the edge of the opening of the container, before first opening, there is provided a membrane which is either sealed or glued or welded, and which can easily be peeled off if necessary. When the container has been opened for the first time, secondary sealing has to be guaranteed so as to minimize the risks of organoleptic deterioration of the product contained in the said container.

To achieve this, it is necessary to provide inside the lid an inner skirt against which a seal rests. The seal is made of foam or of foam/board composite. The foam is made of polyethylene which may or may not be coated with polyethylene or with polypropylene. The foam needs to have a certain compressibility and a density of between 150 and 250 kg/m$^3$. This seal has a thickness of between 1 and 4 mm.

To improve the guarantee of closure still further, it is possible to provide in the recess of the lid, beside the locking indent, a boss which is parallel to the said indent and of the same length as it. By comparison with the width of the recess in the lid and hence with the width of the locking tab, the tab is substantially one third of this width. The indent and the boss hence have substantially the same dimensions.

The rest of the description is given with reference to the drawings, in which

FIG. 1 represents a perspective view of the hinged closure according to the invention, FIG. 2 is a diagrammatic representation of the hinged closure arranged on a container in the open position, FIG. 3 is a part median section of the hinged closure according to the invention, in the closed position, FIG. 4 is an enlargement of the part A of the section according to FIG. 3, FIG. 5 is an enlargement of the part B of the section according to FIG. 3, FIG. 6 is an enlargement of the part C of the section according to FIG. 3 in a second embodiment, and FIG. 7 is a partial median section of the closure according to the invention with the ring and the lid made as a single piece.

The hinged closure (1) includes a ring (2) designed to fit over the edge of the opening of a container and a lid (3) connected to the said ring by a hinge (4). The lid (3) comprises an end (5), a skirt (6) and a recess (7) with an indent (8) arranged close to the end (5) of the said lid. The ring (2) comprises an outer skirt (11) and an upper edge in two parts: the outer part (12) against which the lower border (13) of the said lid (3) will rest when the lid (3) is closed, and a raised border (14) which also includes catches (15), numbering 4 in the present embodiment. These catches, when the hinged closure is fitted, make it possible to ensure that the said closure is held fast on the edge of the opening of the container. According to the invention, there is provided on the ring, on the opposite side to the hinge (4), a locking tab (9) of width substantially equal to the width of the recess (7) in the lid, this locking tab (9) including a tab (10) intended to be housed in the indent (8) in the lid. The locking tab is hinged onto the said ring (2) using a hinge (20). Finally, a seal (18) is provided in the lid (3); this seal is held in place by virtue of catches (19) (FIG. 3).

The operation of the closure will be better understood with relation to FIG. 2, showing the said closure on the container (16). First of all, the ring (2) has to be forcibly fitted onto the upper edge (17) of the opening of the said container. If we start from the open position, as represented in FIG. 2, the lid (3) has to be pivoted about the hinge (4) in a closing direction until the lower part of the skirt (6) presses on the outer part (12) of the edge of the ring (2). The raised part (14) ensures that the closure is held fast on the neck of the container. All that is then required is to push the locking tab (9) towards the closed lid, so that the tab (10) clips into the indent (8).

FIGS. 3 to 5 are partial sections of FIG. 2 and to a large extent use the same elements of the first two Figures: these Figures show an embodiment with a ring and a lid made in two parts. We shall consequently limit ourselves to explanations not yet given with respect to the said first Figures. Clearly visible in FIG. 3 is an inner skirt (21), against which the seal (18) rests, the said seal being held in place by virtue of the catches (19). FIGS. 4 and 5 clearly show the container (16) with the upper edge (17) and on the neck a rim (22) holding the ring (2) fast to prevent it from coming off upwards, and a rim (23) making it possible to prevent the said ring from slipping down.

With reference to FIG. 3, it is possible to see the tab (10) clipped into the indent (8). Furthermore, it is also possible to see that the seal (18) requires a certain degree of elasticity to allow it to be compressed between the inner skirt (21) of the lid and the upper edge (17) of the container (16), thus ensuring good sealing.

With reference to FIG. 4, it can clearly be seen that the lower part (12) of the ring (2) will serve as a limit stop against the rim (23) of the container to prevent the said ring from slipping down and that the raised part (14) of the said ring will butt against the rim (22) of the container to prevent any possibility of the said ring coming off the neck of the said container.

With reference to FIG. 5, it is clear that we have a ring (2) and a lid (3) made as two parts: what happens is that the lid (3) pivots about the hinge (4) and has an extension (24) which clips over the ring (2).

FIG. 6 is an enlargement of the locking tab with its tab (10) and the indent (8) in which it is housed, according to an embodiment which differs from the preceding Figures. To improve the guarantee of closure still further, an additional boss (25) is provided in the lid (3), beside the indent (8). The tab (10) is thus positioned in the indent (8) and, to open it, an additional force is required to get over the boss (25).

FIG. 7 shows the container (16) capped by a hinged closure (30) made of a single piece. The ring (31) bears a lid (32) which is hinged on using a hinge (33), the lid including an inner skirt (34). The seal is not represented in this Figure. The ring (31) includes a locking tab (35) pivoting about the hinge (36), the said tab comprising a tab (37) which clips into the indent (38) located in the recess (39) in the lid (32).

In the closure according to the invention, we have the lid and the locking tab which both include hinges. It is quite obvious that the plastic used must be able to be strong enough to withstand at least 300 opening operations without breaking. Polypropylene is satisfactory in any case. However, it is quite obvious that other materials could also serve this purpose.

We claim:

1. A closure for a container wherein the closure comprises a ring member, a lid member, a first hinge which connects the ring and lid members, and a locking tab member, hinge and protrusion member assembly wherein:

the lid member comprises:

(a) skirt portion which extends from a skirt portion edge and about an opening; and (b) a wall portion which extends transversely from the skirt portion at a position displaced a distance from the skirt portion edge and wherein the wall portion comprises an interior surface which faces the skirt portion opening and an exterior surface which opposes the interior surface and which comprises a recess portion which extends from the skirt portion and which comprises an indent portion positioned in the recess portion;

the first hinge is connected to the lid member at a position which opposes the lid member recess portion;

the ring member comprises a skirt which extends from a skirt edge and wherein the ring member skirt and edge portion is configured so that the ring member edge portion is mateable with the lid skirt portion edge to effect mated lid member skirt edge-to-ring member skirt edge closure and wherein the ring member skirt is connected to the first hinge so that the lid and ring members are reciprocatable to and from one another to effect the edge-to-edge closure; and the locking tab member, hinge and protrusion member assembly comprises an assembly hinge connected to the ring member, a tab which extends from the ring member and a protrusion which projects from the tab member, wherein the assembly is positioned and configured so that upon the mated edge-to-edge closure, the tab extends to the lid member recess portion and so that the protrusion removably connects to the lid member indent portion to hold the lid member and ring member together.

2. A closure according to claim 1 wherein the ring member further comprises a flange which extends from the ring member skirt edge portion into the opening to provide a rim member.

3. A closure according to claim 1 or 2 wherein the lid recess portion further defines a boss juxtaposed to the indent portion for restraining the locking tab protrusion.

4. A closure according to claim 2 wherein the ring member further comprises a border member which extends transversely from the flange and is positioned for abutting the lid member skirt portion.

5. A closure according to claim 4 wherein the ring member further comprises catch protrusions which extend from the border member in a direction transverse to the border member.

6. A closure according to claim 1 or 2 further comprising a plurality of catch protrusions which extend transversely from the lid member skirt portion into the skirt portion opening, a second skirt which extends transversely from the wall portion interior surface, and a seal member which extends across the skirt portion opening, wherein the catch protrusions, the second skirt member and the seal member are configured and positioned so that the seal member extends between the second skirt member and the catch protrusions and so that the second skirt member and catch protrusions hold the seal member therebetween.

7. A closure according to claim 6 wherein the lid recess portion further defines a boss juxtaposed to the indent portion for restraining the locking tab protrusion.

8. A closure according to claim 6 wherein the seal member comprises a foamed material and a board material.

9. A closure according to claim 6 wherein the ring member further comprises a border member which extends transversely from the flange and is positioned for abutting the lid member skirt portion.

10. A closure according to claim 9 wherein the ring member further comprises catch protrusions which extend from the border member in a direction transverse to the border member.

11. A closure according to claim 6 wherein the seal member comprises a foamed material.

12. A closure according to claim 11 wherein the foamed material is a foamed polypropylene.

13. A closure according to claim 11 wherein the foamed material has a density of between 150 $kg/m^3$ to 250 $kg/m^3$.

* * * * *

UNITED STATES PATENT AND TRADEMARK OFFICE

CERTIFICATE OF CORRECTION

PATENT NO. : 5,810,188
DATED : September 22, 1998
INVENTOR(S) : Novakoski et al.

It is certified that error appears in the above-identified patent and that said Letters Patent is hereby corrected as shown below:

Please delete columns 1-4 and substitute columns 1-6 as per attached.

Signed and Sealed this

Twelfth Day of March, 2002

*Attest:*

*Attesting Officer*

JAMES E. ROGAN
*Director of the United States Patent and Trademark Office*

HINGED CLOSURE FOR CONTAINER

BACKGROUND OF THE INVENTION

The invention relates to a hinged closure for a container, this closure including a ring designed to fit a wall of a container about a container opening, as well as a lid which is connected to the ring by a hinge and which presses against this ring in the closed position.

French Patent Application Publication No. 2 529 865 already relates to a hinged closure for a container of oblong cross-section with a ring sealed on a wall of the container about the container opening and a lid connected to the ring by a hinge. This closure comprises a locking system with a protrusion on the ring which is designed to engage in a hole in the lid. The drawback of this solution is that when the lid is closed, it is very difficult to open it because it is not known, a priori, how to disengage the protrusion.

SUMMARY OF THE INVENTION

The object of the present is provision of a hinged closure system which gives easy opening for the the user, while at the same time guaranteeing good sealing, both primary and secondary. Primary sealing is understood to be sealing before first opening, and secondary sealing is understood to be after first opening.

The present invention provides a hinged closure for a container, wherein the closure includes a ring designed to fit a wall of the container about the opening of the container and includes a lid which is connected to the ring by a hinge and which presses against the ring in the closed position, characterized in that the ring includes, on the opposite side to the hinge, a locking tab having a protrusion which provides a clipping tab, wherein the locking tab is hinged onto the ring and intended to the housed in a corresponding recess in the lid, and the protrusion clipping tab is intended to be clipped into an indent situated in the top of the recess of the lid upon closure.

DETAILED DESCRIPTION OF THE INVENTION

A container, in the present description, is understood to be a container of substantially rectangular or square cross-section, so that the lid and the ring are substantially rectangular or square. If the container is of rectangular cross-section, the two hinges are along the length of the said rectangles. It would also be possible to have a container of substantially elliptical cross-section, in which case the lid and the ring are also of substantially elliptical cross-section, and the hinges are parallel to the major axis of the ellipse.

The container may be used for packaging any pasty, granular or powdered product, particularly instant coffee. It is clearly understood that it can also be used for packaging cosmetic products. The container is preferably made of glass or an equivalent product, and the hinged closure made of polypropylene, polyolefin, or polystyrene, preferably polypropylene. The hinged closure according to the invention may be made as a single piece or as two pieces (lid and ring), and it is moulded or injection-moulded.

The fact that, according to the invention, there is a locking tab having a protrusion which provides a tab for clipping into an indent in the lid makes it possible to have visual security of closure, because the closing of the tab can be clearly seen, and the security of closure is also audible, because clipping gives out a noise which also guarantees correct closing.

On the edge of the opening of the container, before first opening, there is provided a membrane which is either sealed or glued or welded, and which can easily be peeled off if necessary. When the container has been opened for the first time, secondary sealing has to be guaranteed so as to minimize the risks of organoleptic deterioration of the product contained in the said container.

To achieve secondary sealing, it is necessary to provide inside the lid an inner skirt against which a seal rests. The seal is made of foam or of foam/board composite. The foam is made of polyethylene which may or may not be coated with polyethylene or with polypropylene. The foam needs to have a certain compressibility and a density of between 150 and 250 kg/m$^3$. This seal has a thickness of between 1 and 4 mm.

To improve the guarantee of closure still further, it is possible to provide in the recess of the lid, beside the locking indent, a boss which is parallel to the said indent and of the same length as it. By comparison with the width of the recess in the lid and hence with the width of the locking tab, the tab is substantially one third of this width. The indent and the boss hence have substantially the same dimensions.

The rest of the description is given with reference to the drawings.

DETAILED DESCRIPTION OF THE DRAWING FIGURES

Figure 1:
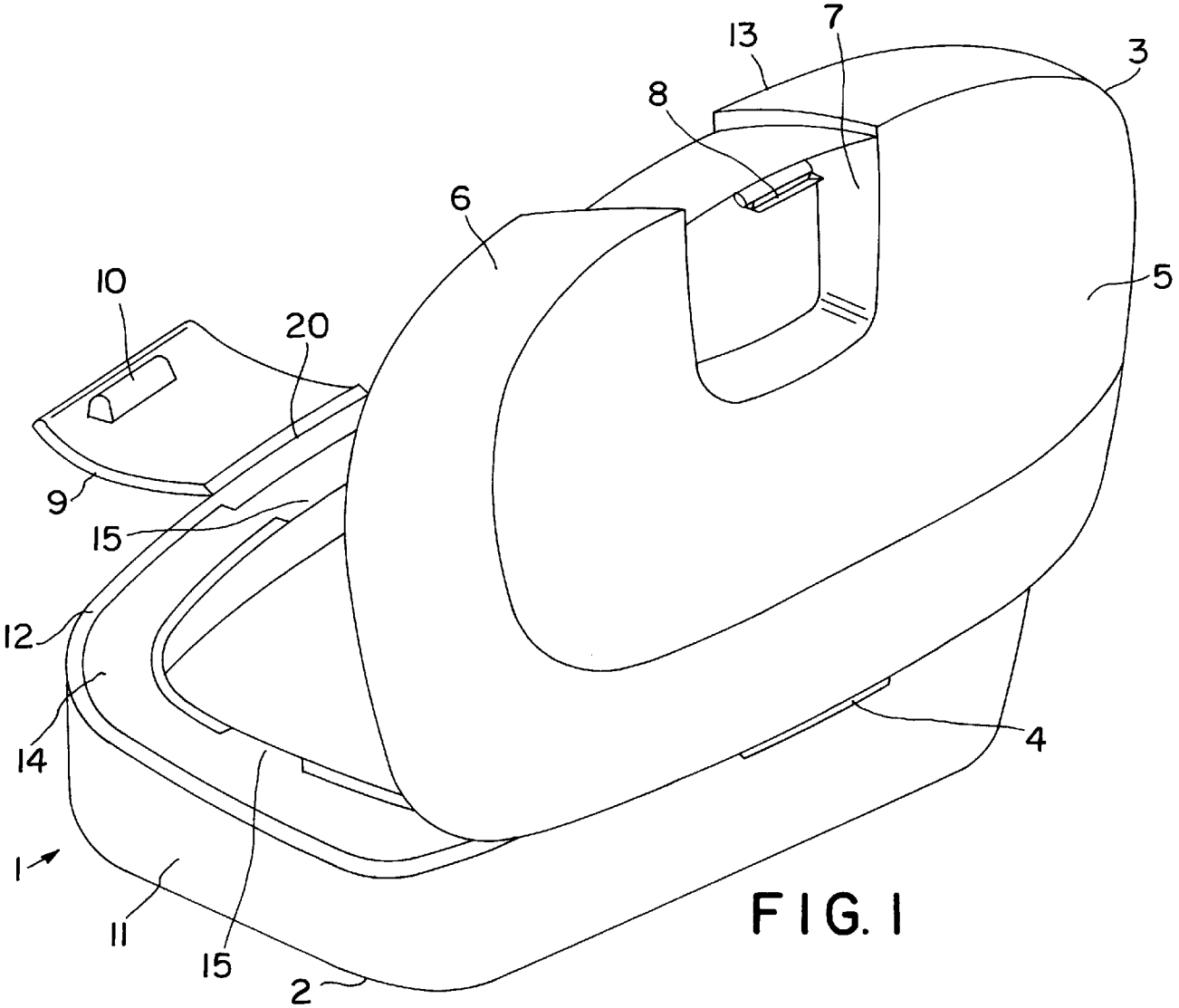
FIG. 1 represents a perspective view of the hinged closure according to the invention.

As illustrated in FIG. 1, the hinged closure (1) includes a ring (2) designed to fit over the edge of the opening of a container and includes a lid (3) connected to the ring by a hinge (4). The lid (3) comprises a wall portion (5) which extends transversely from a skirt portion (6) which, in turn, extends from a skirt portion edge which is displaced a distance away from wall portion (5) and about a lid opening. The wall portion (5) has an interior surface which faces the skirt portion opening and has an exterior surface which opposes the interior surface and which comprises a recess portion (7) which extends from the skirt portion and which comprises an incident portion (8) arranged close to the edge of recess portion (7).

The ring (2) comprises an outer skirt (11) and an upper edge in two parts. The upper edge has outer part (12) against which the lower border (13) of the lid (3) mates and rests when the lid (3) is closed, and the upper edge has an inner raised border (14) which also includes catches (15) (4 in number in the embodiment illustrated in FIG. 1). These catches, when the hinged closure is fitted, make it possible to ensure that the closure is held fast on the edge of the opening of the container.

Figure 2:
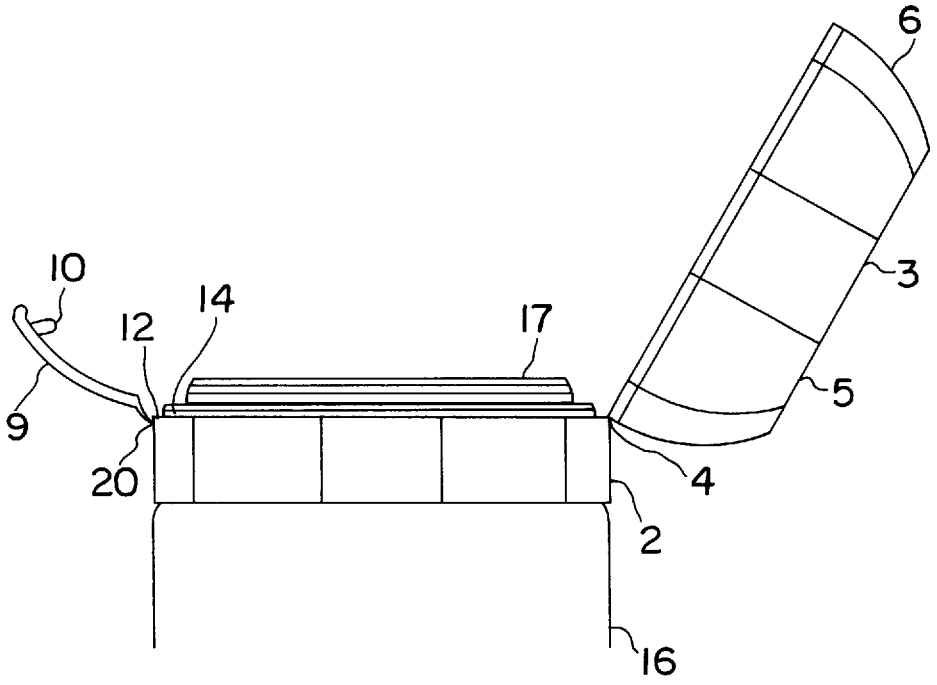
FIG. 2 is a diagrammatic representation of the hinged closure arranged on a container in the open position.
Figure 3:
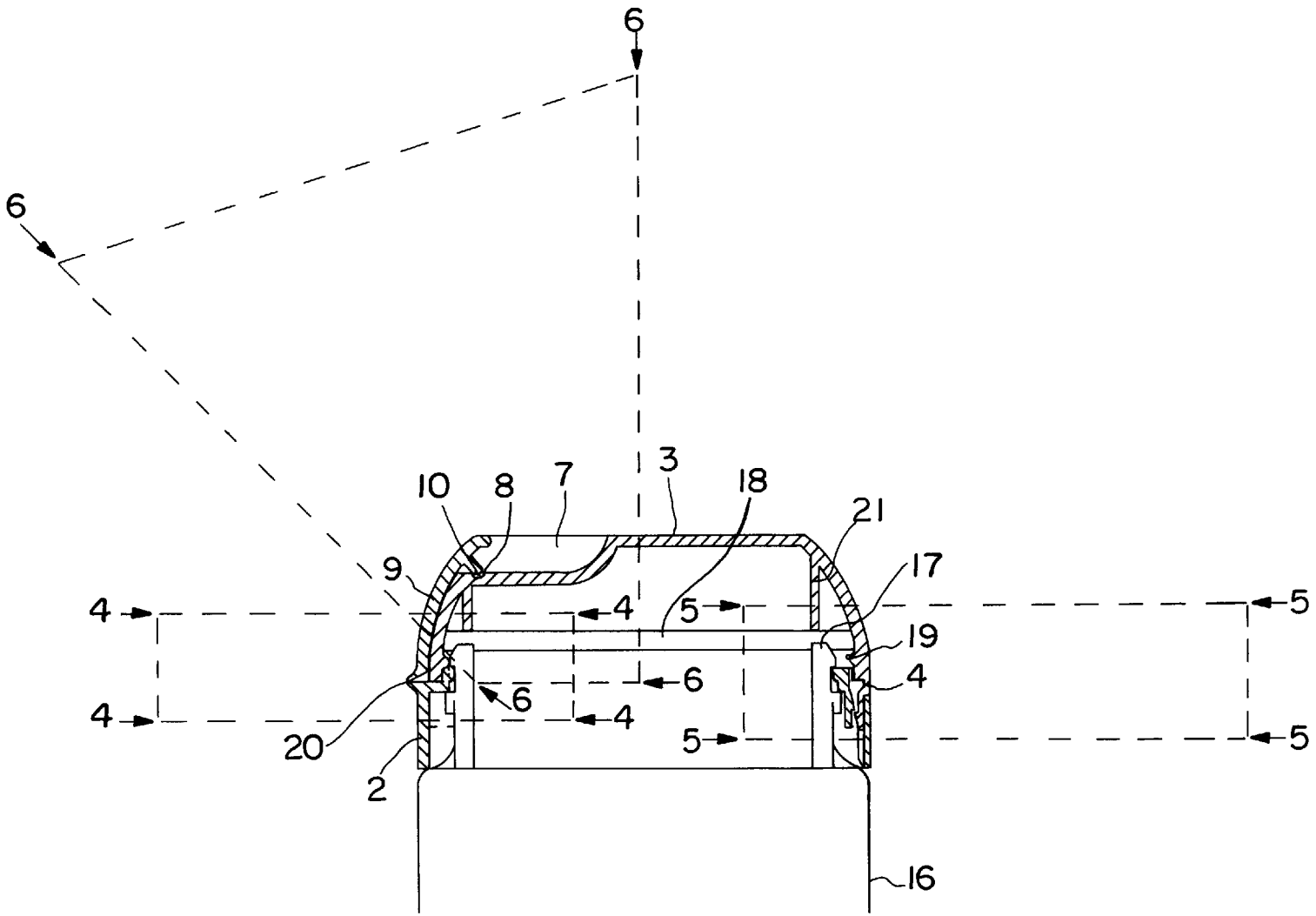
FIG. 3 is a part median section of the hinged closure according to the invention, in the closed position.

According to the invention illustrated in FIGS. 1-3, there is provided on the ring, on the opposite side to the hinge (4), a locking tab member, hinge and protrusion member assembly. The locking tab (9) has a width substantially equal to the width of the recess portion (7) in the lid so that it fits within the recess, this locking tab (9) including a protrusion which provides clipping tab (10) intended to be housed in and removably connected into the indent surface portion (8) in the lid to hold the lid and ring together. The locking tab is hinged onto the ring (2) using a hinge (20). Finally, a seal (18) is provided in the lid (3). The seal is held in place by virtue of catches (19) (FIG. 3).

The operation of the closure will be better understood with relation to FIG. 2, showing the closure on the container (16). First of all, the ring (2) has to be forcibly fitted onto the container upper edge (17) about the opening of the container. Starting from the open position, as represented in FIG. 2, the lid (3) is reciprocatable and is pivoted about the hinge (4) in a closing direction until the lower part of the edge of the lid skirt portion (6) mates with and presses on the outer part (12) of the edge of the ring (2) to provide edge-to-edge closure. The raised part (14) ensures that the closure is held fast on the neck of the container. All that is then required is to push the locking tab (9) towards the closed lid, so that the protrusion tab (10) clips into the indent portion (8).

Figure 4:
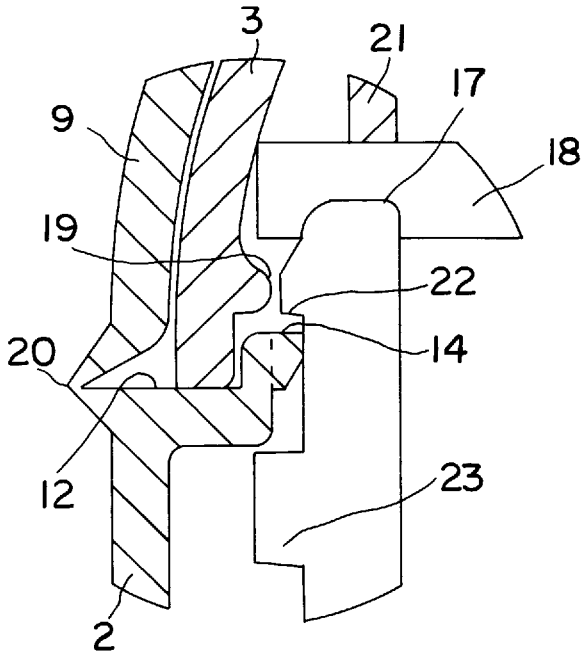
FIG. 4 is an enlargement of section 4—4 according to FIG. 3.
Figure 5:
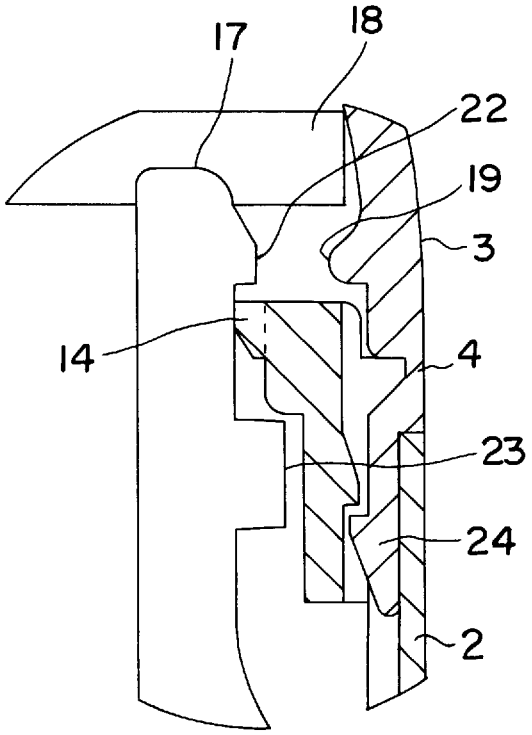
FIG. 5 is an enlargement of section 5—5 according to FIG. 3.

FIGS. 3 to 5, which are partial sections of FIG. 2, and to a large extent illustrate the same elements of the first two Figures, show an embodiment with a ring and a lid made in two parts, and this description consequently is limited to explanations not yet given with respect to the first Figures. Visible in FIG. 3 is an inner skirt (21), against which the seal (18) rests, the skirt (21) extending transversely from lid wall portion (5) and the seal 18 is held in place by virtue of the catches (19) which, as illustrated, protrude transversely from lid skirt portion (6). FIGS. 4 and 5 show the container (16) with the upper edge (17), and on the container neck is a rim (22) holding the ring (2) fast to prevent it from coming off upwards, and a further rim (23) on the container neck makes it possible to prevent the ring from slipping down.

With further reference to FIG. 3, it is possible to see the protrusion clipping tab (10) clipped into the indent (8). Furthermore, it is also possible to see that the seal (18) requires a certain degree of elasticity to allow it to be compressed between the inner skirt (21) of the lid and the upper edge (17) of the container (16), thus ensuring good sealing.

With reference to FIG. 4, it can be seen that the flange part (12) of the ring (2) provides a rim and will serve as a limit stop against the rim (23) of the container to prevent the ring from slipping down and that the raised border part (14) of the ring will butt against the rim (22) of the container to prevent any possibility of the ring coming off the neck of the container.

With reference to FIG. 5, a ring (2) and a lid (3) are made as two parts. What happens in operation is that the lid (3) pivots about the hinge (4) and has an extension (24) which clips over the ring (2).

Figure 6:
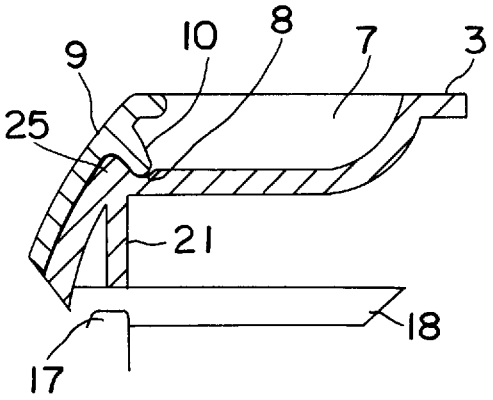
FIG. 6 is an enlargement of section 6—6 according to FIG. 3.

FIG. 6 is an enlargement of the locking tab with its protrusion clipping tab (10) and the indent (8) in which the protrusion (10) is housed, according to an embodiment which differs from the preceding Figures. To improve the guarantee of closure still further, an additional boss (25) is provided in the lid (3), beside the indent (8). The protrusion tab (10) is thus positioned in the indent (8), and for opening an additional force is required to get over the boss (25).

Figure 7:
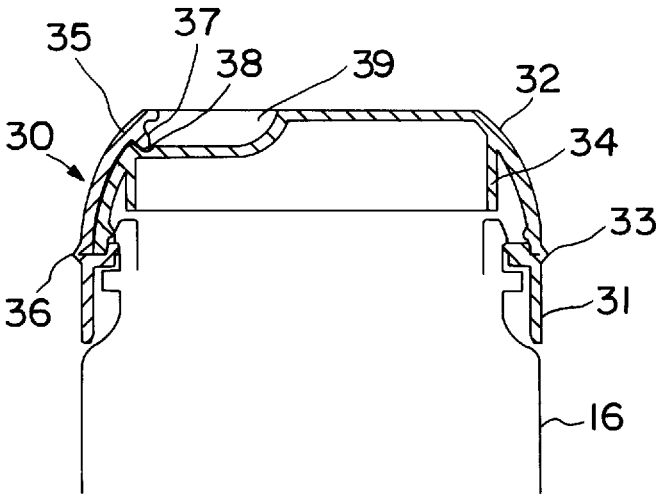
FIG. 7 is a partial median section of the closure according to the invention with the ring and the lid made as a single piece.

FIG. 7 shows the container (16) capped by a hinged closure (30) made of a single piece. The ring (31) bears a lid

(32) which is hinged on using a hinge (33), the lid including an inner skirt (34). The seal is not represented in this Figure. The ring (31) includes a locking tab (35) which pivots about the hinge (36), the tab comprising a protrusion clipping tab (37) which clips into the indent (38) located in the recess (39) in the lid (32).

In the closure according to the invention, the lid and the locking tab which both include hinges. It is quite obvious that the plastic used must be able to be strong enough to withstand at least 300 opening operations without breaking. Polypropylene is satisfactory in any case. However, it is quite obvious that other materials could also serve this purpose.

We claim:

1. A closure for a container wherein the closure comprises a ring member, a lid member, a first hinge which connects the ring and lid members, and a locking tab member, hinge and protrusion member assembly wherein:

the lid member comprises:

(a) skirt portion which extends from a skirt portion edge and about an opening; and (b) a wall portion which extends transversely from the skirt portion at a position displaced a distance from the skirt portion edge and wherein the wall portion comprises an interior surface which faces the skirt portion opening and an exterior surface which opposes the interior surface and which comprises a recess portion which extends from the skirt portion and which comprises an indent portion positioned in the recess portion;

the first hinge is connected to the lid member at a position which opposes the lid member recess portion;

the ring member comprises a skirt which extends from a skirt edge and wherein the ring member skirt and edge portion is configured so that the ring member edge portion is mateable with the lid skirt portion edge to effect mated lid member skirt edge-to-ring member skirt edge closure and wherein the ring member skirt is connected to the first hinge so that the lid and ring members are reciprocatable to and from one another to effect the edge-to-edge closure; and the locking tab member, hinge and protrusion member assembly comprises an assembly hinge connected to the ring member, a tab which extends from the ring member and a protrusion which projects from the tab member, wherein the assembly is positioned and configured so that upon the mated edge-to-edge closure, the tab extends to the lid member recess portion and so that the protrusion removably connects to the lid member indent portion to hold the lid member and ring member together.

2. A closure according to claim 1 wherein the ring member further comprises a flange which extends from the ring member skirt edge portion into the opening to provide a rim member.

3. A closure according to claim 1 or 2 wherein the lid recess portion further defines a boss juxtaposed to the indent portion for restraining the locking tab protrusion.

4. A closure according to claim 2 wherein the ring member further comprises a border member which extends transversely from the flange and is positioned for abutting the lid member skirt portion.

5. A closure according to claim 4 wherein the ring member further comprises catch protrusions which extend from the border member in a direction transverse to the border member.

6. A closure according to claim 1 or 2 further comprising a plurality of catch protrusions which extend transversely from the lid member skirt portion into the skirt portion opening, a second skirt which extends transversely from the wall portion interior surface, and a seal member which extends across the skirt portion opening, wherein the catch protrusions, the second skirt member and the seal member are configured and positioned so that the seal member extends between the second skirt member and the catch protrusions and so that the second skirt member and catch protrusions hold the seal member therebetween.

7. A closure according to claim 6 wherein the lid recess portion further defines a boss juxtaposed to the indent portion for restraining the locking tab protrusion.

8. A closure according to claim 6 wherein the seal member comprises a foamed material and a board material.

9. A closure according to claim 6 wherein the ring member further comprises a border member which extends transversely from the flange and is positioned for abutting the lid member skirt portion.

10. A closure according to claim 9 wherein the ring member further comprises catch protrusions which extend from the border member in a direction transverse to the border member.

11. A closure according to claim 6 wherein the seal member comprises a foamed material.

12. A closure according to claim 11 wherein the foamed material is a foamed polypropylene.

13. A closure according to claim 11 wherein the foamed material has a density of between 150 $kg/m^3$ to 250 $kg/m^3$.

* * * * *